US006030171A

United States Patent [19]

Johnson et al.

[11] Patent Number: 6,030,171

[45] Date of Patent: Feb. 29, 2000

[54] BATTERY PLATE FEEDER HAVING OSCILLATING PICK-UP HEAD

[75] Inventors: Peter E. Johnson; David A. Johnson, both of Corvallis, Oreg.

[73] Assignee: Tekmax, Inc., Tangent, Oreg.

[21] Appl. No.: 09/227,454

[22] Filed: Jan. 8, 1999

Related U.S. Application Data

[63] Continuation of application No. 09/055,851, Apr. 8, 1998.

[51] Int. Cl.[7] ..... B65G 59/000

[52] U.S. Cl. ..... 414/797; 414/801

[58] Field of Search ..... 271/94, 95, 96, 271/158, 159; 414/736, 737, 797, 797.3, 798.9, 801

[56] References Cited

U.S. PATENT DOCUMENTS

| | | | |
|---|---|---|---|
| 4,462,745 | 7/1984 | Johnson et al. | 414/798.9 |
| 4,758,126 | 7/1988 | Johnson et al. | 414/798.9 |
| 5,775,871 | 7/1998 | Redden | 414/797 X |

FOREIGN PATENT DOCUMENTS

| | | | |
|---|---|---|---|
| 2 098 586 | 11/1982 | United Kingdom | 414/797 |

*Primary Examiner*—Janice L. Krizek
*Attorney, Agent, or Firm*—Chernoff, Vilhauer, McClung & Stenzel

[57] ABSTRACT

A plate feed apparatus has a cylindrical pick-up head having a predetermined number of pick-up units spaced about its periphery. The pick-up head is attached to and rotates with a first shaft at a first rotational speed. A feed mechanism places the uppermost plate in a stack of plates a nominal distance from the periphery of the pick-up head each time a plate is removed from the stack. A vacuum device is selectively coupled to each pick-up unit as it passes over the stack to pull the outermost plate away from the stack and into contact with the pick-up unit. A second shaft has a cylindrical bore which rotatably journals the first shaft and is offset from the centerline of the second shaft. The second shaft is rotated counter to the first shaft at a speed which is a multiple of the speed of the first shaft equal to the number of pick-up units. This causes the speed of the pick-up unit to be slower and its distance from the uppermost plate in the stack less each time a pick-up unit picks up a plate. The feed mechanism has fingers which are inserted under the stack of plates before the stack becomes depleted to keep advancing the stack as plates are removed and allow the feed mechanism platform to be lowered to receive a new stack of plates. A microprocessor based controller directs this activity without disruption of the feed mechanism.

4 Claims, 10 Drawing Sheets

BATTERY PLATE FEEDER HAVING OSCILLATING PICK-UP HEAD

This application is a continuation of Ser. No. 09/055,851 filed Apr. 8, 1998.

BACKGROUND AND SUMMARY OF THE INVENTION

The subject invention relates to a battery plate feeder and in particular to a plate feeder which picks plates serially off of a vertical stack of plates which is moved upwardly toward the pick-up head each time a plate is removed from the stack.

Plates for storage batteries are serially fed to another machine which inserts them into microporous pouches for insertion into battery cases. Mechanical plate feeders are used to remove plates from a stack of plates and feed them to the other machine. The prior art battery plate feeders continuously urge a horizontal stack of plates against a rotating cylindrical pick-up head having multiple pick-up units located about its periphery. Vacuum is introduced in each pick-up unit as it reaches the stack of plates to cause the forwardmost plate in the stack to become affixed to the pick-up unit, and the vacuum is discontinued when the plate reaches an outfeed conveyer which carries the plate to the sealing machine.

In order to keep the plate being removed from striking the next plate in the stack, and thus either dislodging the plate from the pick-up unit or displacing the next plate in the stack, a gap must be created between the forwardmost plate in the stack and the pick-up head. The vacuum then pulls the forwardmost plate across this gap into contact with the pick-up unit. Since the plates are being continuously urged toward the pick-up head in the prior art plate feeders, this gap must be created by holding the stack back from the pick-up unit or by pushing the stack away from the pick-up unit immediately before a pick-up unit comes into alignment with the stack.

In Johnson, et al., U.S. Pat. No. 4,462,745, this gap is created by placing the pick-up units on chordal segments of the pick-up head thereby placing them radially inwardly of the periphery of the pick-up head. The periphery of the pick-up head then holds the stack away from the pick-up unit until a pick-up unit arrives. In Johnson, et al., U.S. Pat. No. 4,758,126, push-back rollers are placed at the periphery of the pick-up head in front of each pick-up unit and the rollers push the stack of plates back from the periphery of the pick-up head as a pick-up unit approaches. Because of this need to hold the plates back or push the plates back to create a gap between the pick-up unit and the stack or plates, the gap is not consistent in the prior art feeders. In addition, a plate being picked up by a pick-up unit can only be successfully gripped if the amount the plate is accelerated when it is picked up is kept below a certain level. In order to stay below this level of acceleration, the surface speed of the plates should not exceed approximately 100 feet per minute. Finally, because the plates have to be separated from one another as they are conveyed away from the device for further processing, the plates have heretofore been separated from one another on the pick-up head also. As a result, the prior art plate feeders have been limited to the number of pick-up units that will not result in overlapping of the plates. This need to maintain plate separation on the pick-up head and not to exceed a certain pick-up unit surface speed at pick up has placed a limit on the rate at which plates can be fed on this type of machine.

The need exists, therefore, to feed plates cleanly at a higher rate than is possible with these prior art devices.

While plate feed apparatus have in the past fed plates from vertical stacks that are lifted toward the pick-up head each time a plate is removed from the stack, vertical stack feed mechanisms have not heretofore had enough precision to be used in conjunction with rotating cylindrical pick-up heads having multiple pick-up units through which a vacuum is drawn to feed battery plates.

A first aspect at the subject invention overcomes the difficulty prior art battery plate feeders have in creating a uniform gap between the plates and the pick-up unit prior to picking up a plate and allows the pick-up head to be rotated at a higher speed. A cylindrical pick-up head has a predetermined number of pick-up units placed about its periphery. The pick-up head is attached to a first shaft which is coaxial with the centerline of the pick-up head and the pick-up head and the first shaft are rotated at a first rotational speed. A feed mechanism places the outermost plate in a stack of plates a nominal distance from the periphery of the pick-up head each time a plate is removed from the stack. A vacuum device is selectively coupled to each pick-up unit as it is rotated over the stack to draw a vacuum through the pick-up unit and pull the outermost plate away from the stack and into contact with the pickup unit.

A second shaft has a cylindrical bore which rotatably journals the first shaft. The bore on the second shaft is offset from the centerline of the second shaft so that the first and second shafts are not coaxial. The second shaft is rotated counter to the rotation of the first shaft and at a rotational speed that is a multiple of the rotational speed of the first shaft equal to the number of pick-up units. The rotation of the first and second shafts are coordinated such that this counter rotation and axial misalignment causes the surface speed of each pick-up unit to slow down as it rotates into position to pick-up a plate from the stack and causes each pick-up unit to move closer to the stack of plates as it rotates into position to pick-up a plate from the stack. Because the pick-up unit slows down at the pick-up point, the pick-up head can be rotated at a higher rotational speed than would heretofore be possible with a pick-up head having the same diameter, and still not exceed the critical surface speed at pick-up. Thus, higher plate feed rates are possible. Furthermore, since the pick-up head moves closer to the stack when a plate is picked up and then moves further away from the stack, the plates are less likely to strike the stack as they are rotated away from it.

Another aspect the subject invention overcomes the inability at the prior art battery plate feeders to operate above a maximum feed rate without over accelerating the plates upon pick-up, or having the plates overlap one another as they are removed from the feed head. The pick-up head is provided with additional pick-up units, and the plates overlap one another on the pick-up head. The outfeed conveyer, which carries the plates out of the device, has a surface speed which is higher than the surface speed of the pick-up units so that the plates do not overlap one another on the outfeed conveyer. Thus, the acceleration of the plates is divided between pick-up and placement on the outfeed conveyer, and the feed rate can be greatly increased.

A third aspect of the invention overcomes the lack of precision in the prior art vertical feed mechanisms and provides a uniform gap between the pick-up head and the stack of plates. The platform that supports the stacks of plates is raised and lowered by a lifting mechanism. A first sensing device senses when the uppermost plate in the stack is the proper distance from the pick-up head. When a plate is removed from the stack, the first sensing device signals a controller and the controller causes the platform to be raised until the next plate in the stack is sensed by the first sensing device. A second sensing device senses when the platform reaches a predetermined level, which is below the level of the first sensing device. A support frame has a set of fingers which can be inserted under the platform below the stack of plates. An activation mechanism moves the fingers between an extended position under the plates and a retracted position free from the plates. A second lifting mechanism raises and lowers the support frame. When the second sensing device senses the platform is at the predetermined height, it signals the controller and the controller causes the fingers to be inserted under the platform and causes the second lifting mechanism to raise until the fingers engage the stack of plates. The second lifting mechanism then lifts the stack of plates each time a plate is removed from the stack, and the platform is lowered to receive a second stack of plates. When a new stack of plates has been placed on the platform it is raised again until the top of the second stack of plates contacts the bottom of the first stack of plates and the platform then moves the two stacks of plates to maintain the uppermost plate at the proper location and the fingers are moved to their retracted position.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
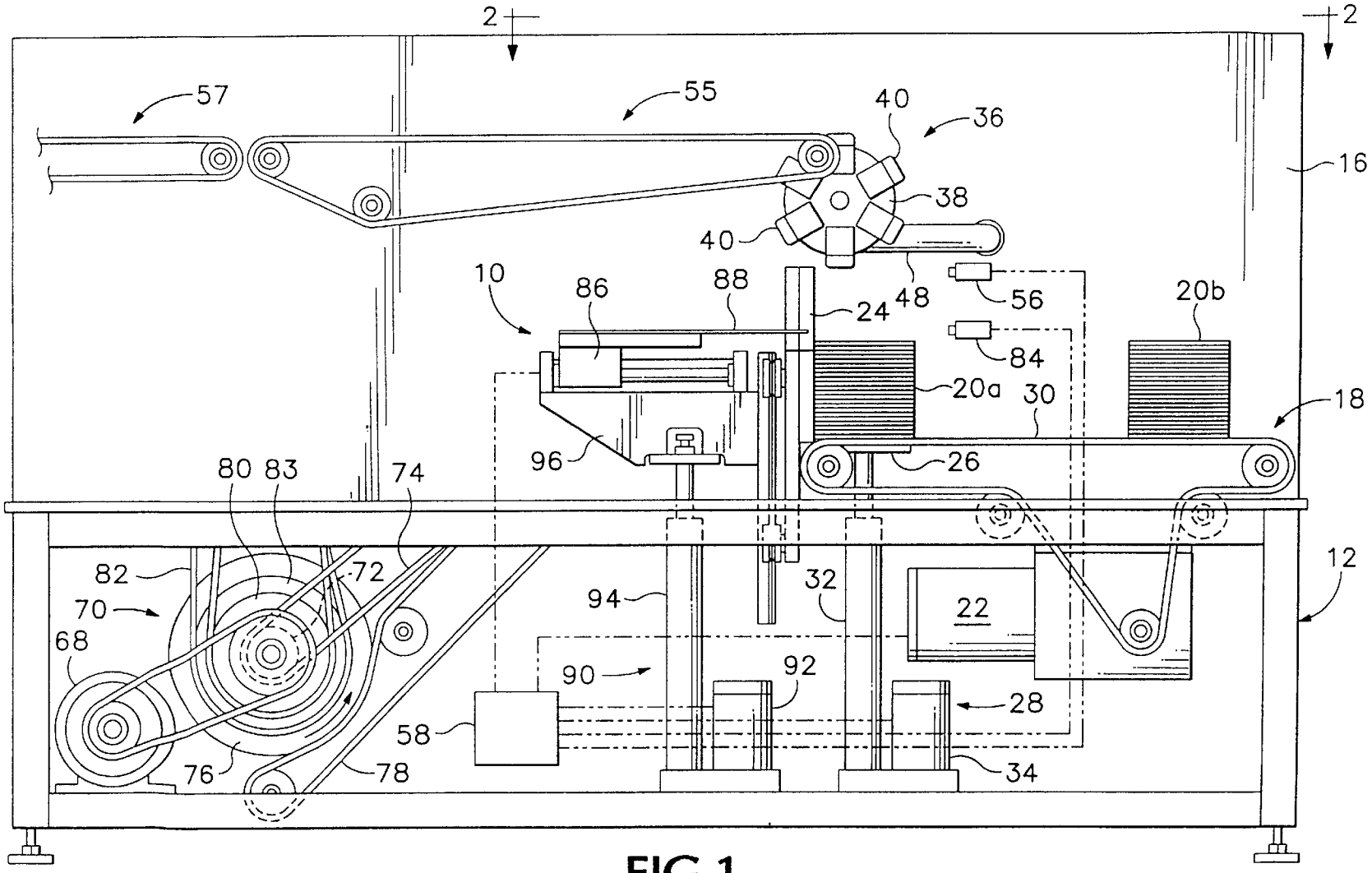
FIG. 1 is a side elevation view showing a plate feed apparatus embodying the subject invention.
Figure 2:
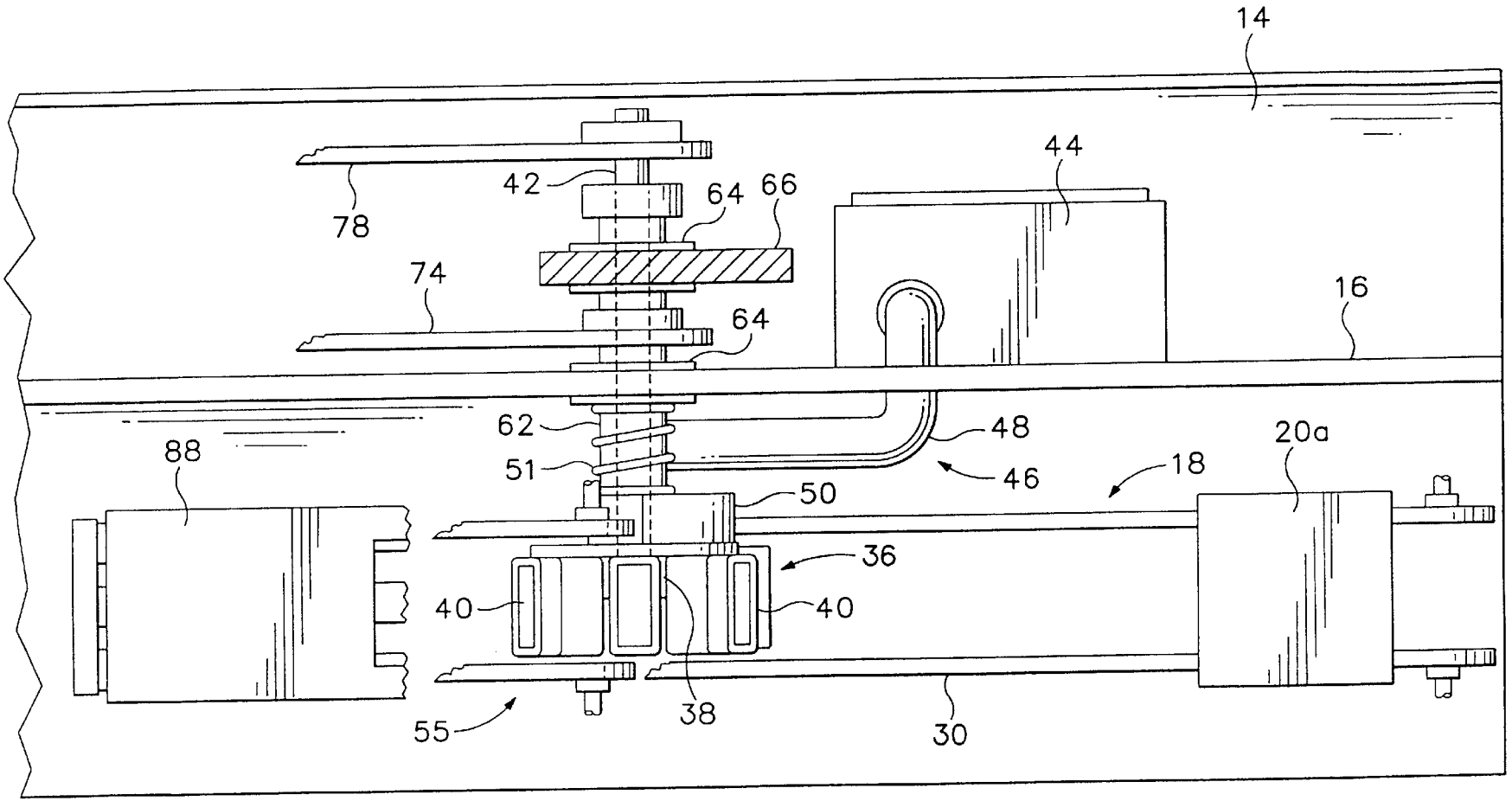
FIG. 2 is a partial plan view of the plate feed apparatus taken on the line 2—2 on FIG. 1, partially broken away to show hidden detail.
Figure 3:
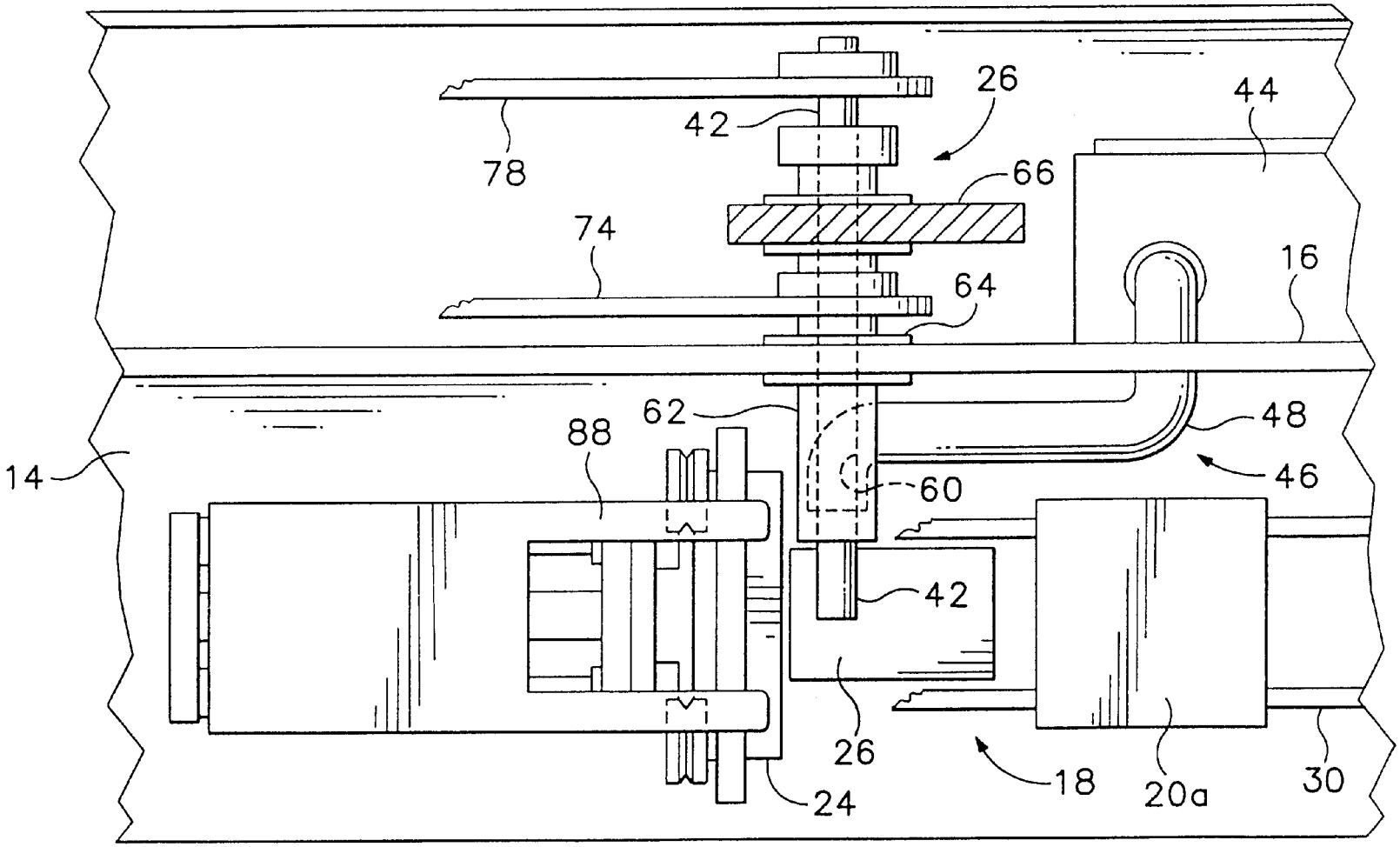
FIG. 3 is a partial plan view, similar to FIG. 2, with parts removed to show hidden detail.

Referring to FIGS. 1–3 of the drawings, a plate feed apparatus 10 is mounted on a table 12 having a planar horizontal top 14. Located medially on the table top 14 is a vertical center wall 16. An infeed conveyer 18, configured to carry the stacks of plates 20(*a*) and 20(*b*) which are to be fed by the apparatus, is located on one side of the table. The infeed conveyer 18 is driven by a motor 22. A stop 24 is located on the table proximate the exit end of the infeed conveyer to allow the stack of plates to be positioned at the proper location for further processing and to align the plates in the stack. A platform 26, located below the stack of plates when it is in contact with the stop, can be raised and lowered by means of a first lifting mechanism 28. The platform is narrower than the plates so that it will fit between the chains 30 or belts of the infeed conveyer 18 and allow the lifting mechanism to lift a stack of plates off of the infeed conveyer. In a preferred embodiment of the device, the first lifting mechanism 28 is a ball screw 32 and electric motor 34, but it can be a hydraulic or pneumatic cylinder or any other type of lifting device.

Located above the lifting mechanism 28 is a feed unit 36. The feed unit 36 includes a cylindrical pick-up head 38 which has a plurality of pick-up units 40 located around its periphery. In the embodiment illustrated, there are six pick-up units but there could be more or less. The pick-up head is mounted on a first shaft 42 which is coaxial with the axial centerline of the pick-up head, and the first shaft and pick-up head rotate together.

Figure 5:
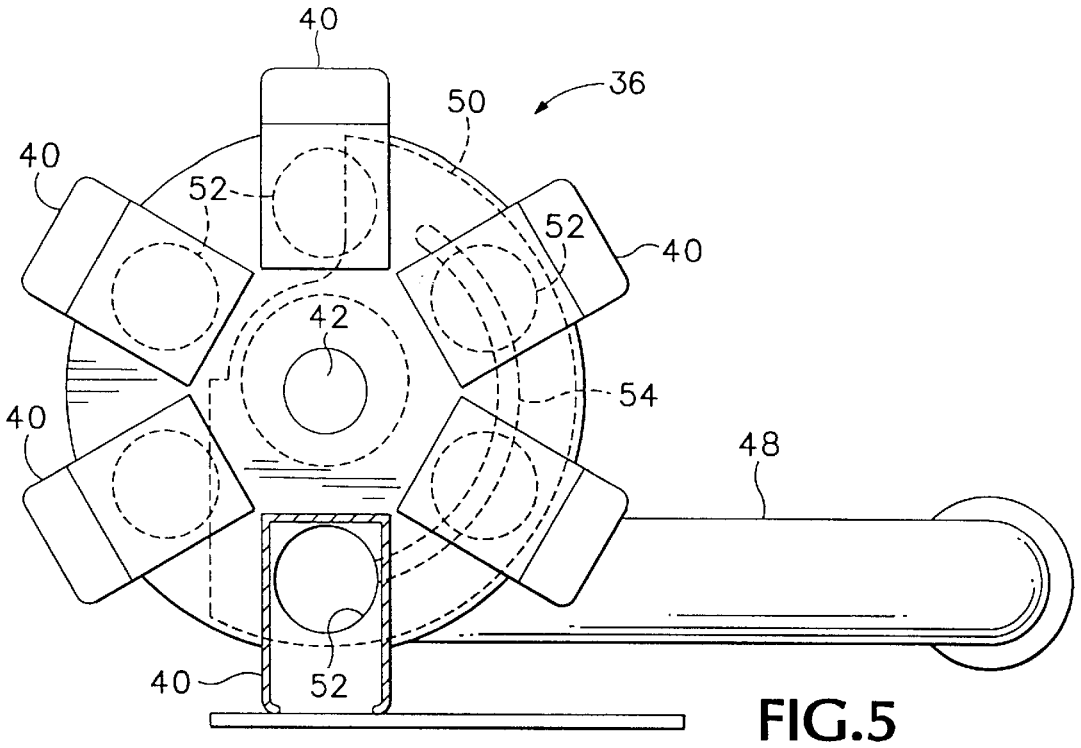
FIG. 5 is a side elevation view of the pick-up head of the plate feed apparatus at an enlarged scale.
Figure 6:
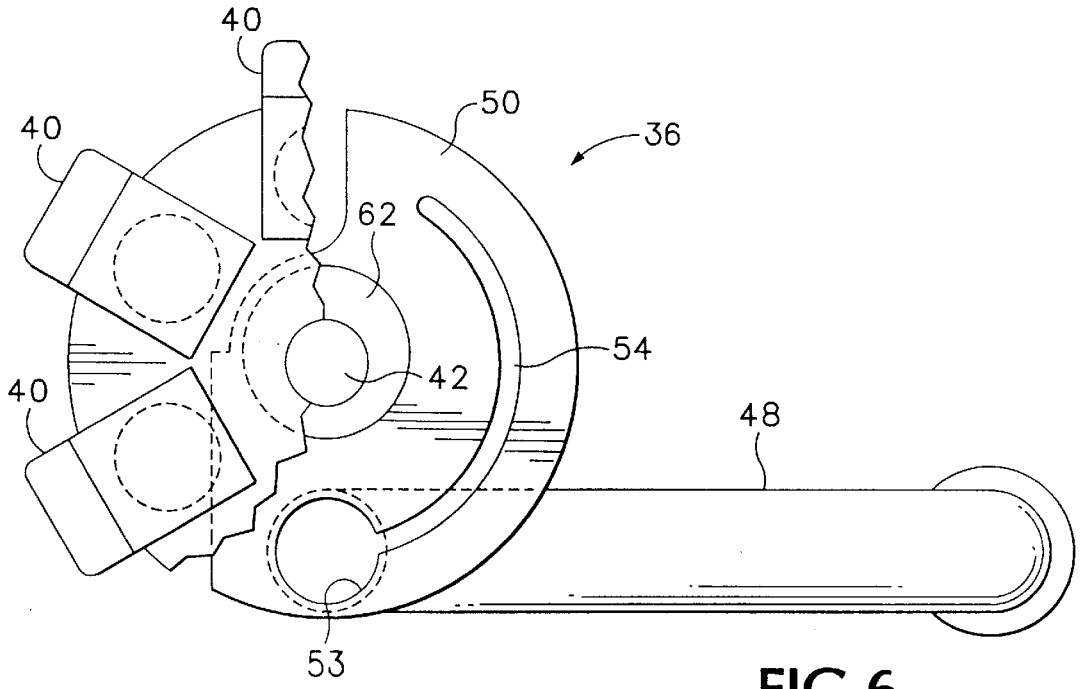
FIG. 6 is a side elevation view, similar to FIG. 5, with parts removed to show hidden detail.

A vacuum source 44 acts through a vacuum distribution system 46 to selectively pull a vacuum through the various pick-up units during portions of their rotation. A pipe 48 interconnects the vacuum source 44 and a distribution block 50, which is located adjacent to the pick-up head but does not rotate with it. The outer face of the distribution block is planar and is held in close sliding contact with the planar inner face of the pick-up head by means of a spring 51. Referring now also to FIGS. 5 and 6, each pick-up unit is fluidly connected to a circular opening 52 on the inner face of the pick-up head. The distribution block has a circular opening 53 that mates with the circular opening 52 of each pick-up unit when that pick-up unit is in position to pick up a plate. The distribution block also has a slot 54 formed in it which extends from the opening 53 slightly less than one-half way around the distribution block and opens into its outer face. The slot 54 intersects the openings 52 in the inner face of the pick-up head as they rotate over it. Thus, a high level of vacuum is pulled through a pick-up unit while its associated opening 52 is aligned with the opening 53 and a lower level of vacuum is pulled through it when it is aligned with the slot 54.

The opening 53 is arranged so that vacuum is initiated in a pick-up unit when that pick-up unit first passes over the stack of plates. Thus, the plates are picked up proximate their trailing edges. With the diameter of the pick-up head, plate size and number of pick-up units shown in the preferred embodiment illustrated, picking the plates up proximate their trailing edges allows the plates to be carried on the pick-up head with the leading edge of each plate overlapping the trailing edge of the previous plate.

Figure 12:
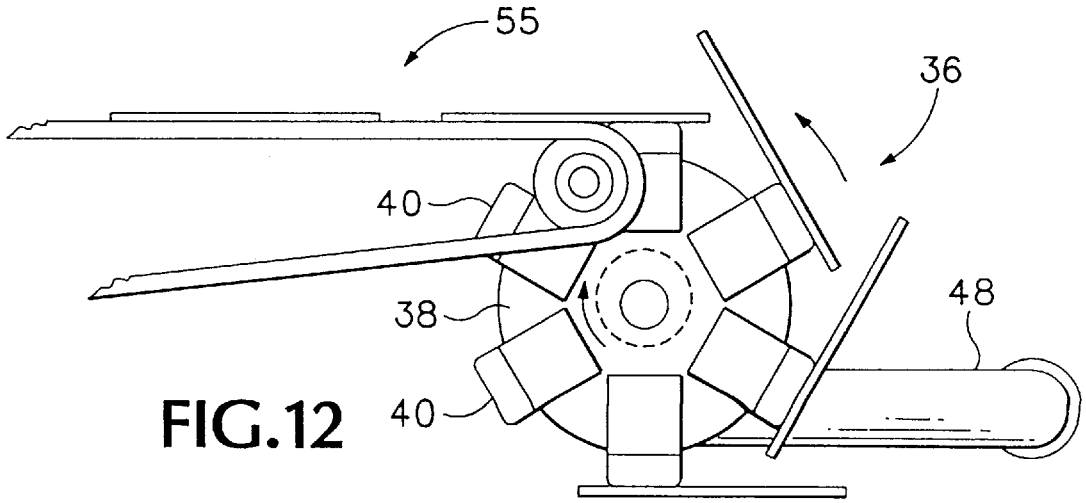
FIG. 12 is a partial side elevation view showing another embodiment of the invention.

The slot 54 is configured to discontinue providing vacuum to a pick-up unit when it has rotated 180 degrees and the plate is again horizontal. At this point, the plate is deposited on an intermediate conveyer 55 which carries the plates away from the pick-up head. The intermediate carrier 55 has a surface speed that is the same as the surface speed of the pick-up unit so that the plates continue to be overlapped as they travel on the intermediate conveyer. An outfeed conveyer 57, located at the end of the intermediate conveyer, has a surface speed that is sufficiently higher than the surface speed of the intermediate conveyer that the plates become separated from one another as they are carried on the outfeed conveyer. It is preferable to have the lower speed intermediate conveyer between the pick-up head and the high speed outfeed conveyer in order to allow further processing of the plates that is easier to accomplish at the slower speed, but the outfeed conveyer could receive the plates directly from the pick-up head, as shown in FIG. 12. In addition, the use of overlapping plates on the pick-up head and a higher speed conveyer to separate them can be used with or without the plate feed system or the oscillating pick-up head described herein.

Figure 7:
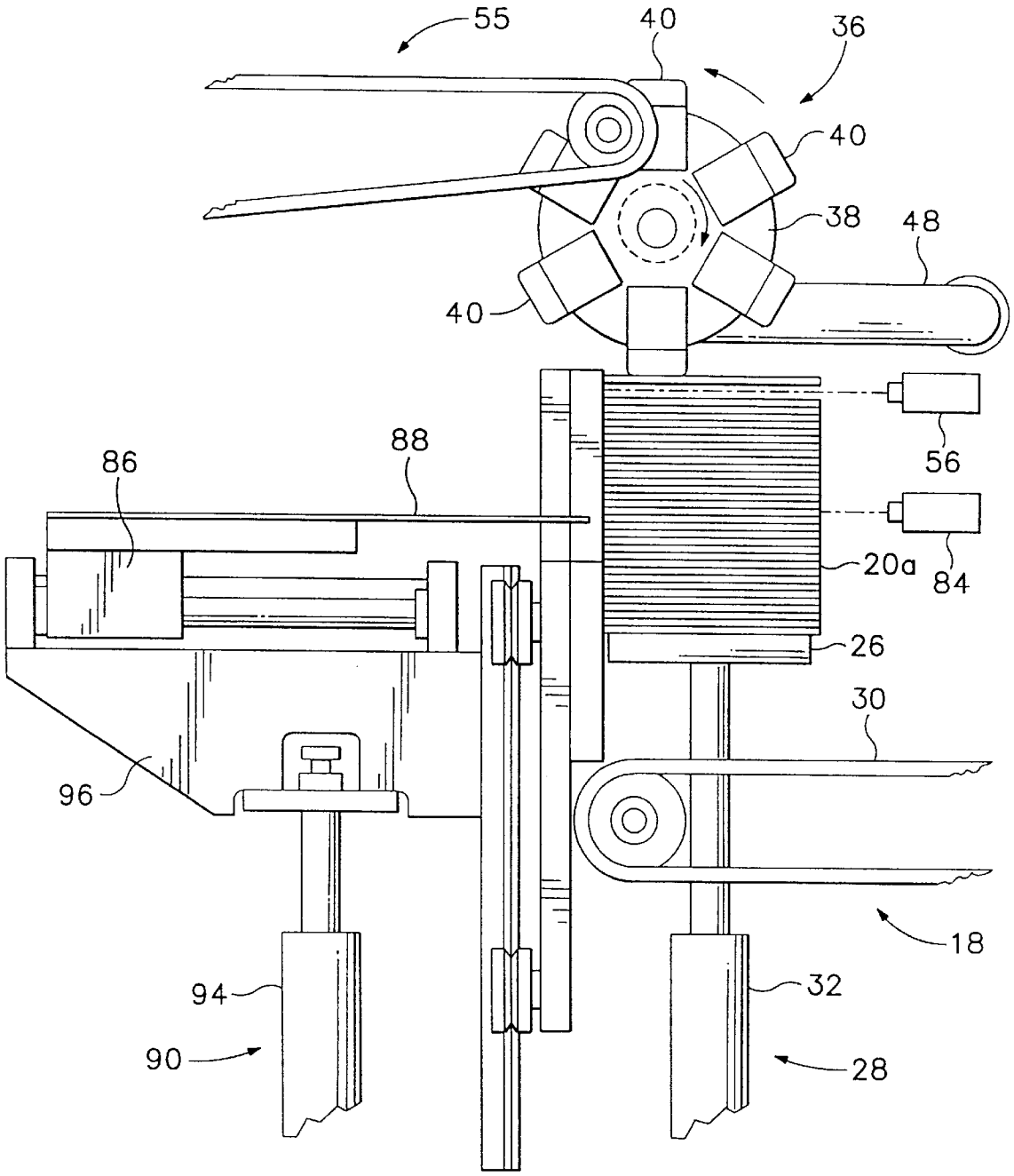
FIGS. 7 and 8 are side elevation views of the plate supply mechanism at an enlarged scale.
Figure 8:
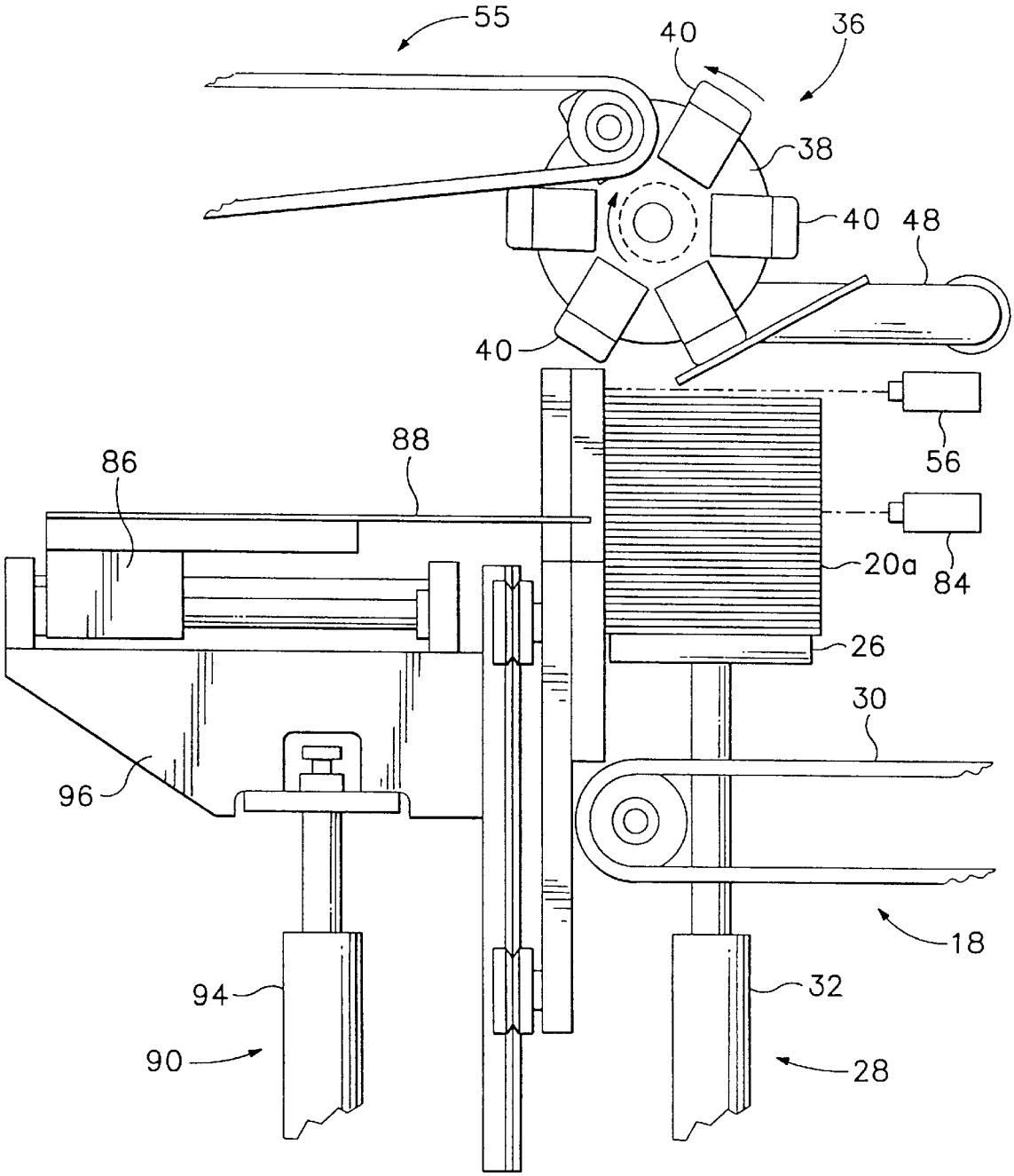

The uppermost plate in the stack is positioned a nominal distance from the pick-up unit which creates a sufficient gap between a plate carried on the pick-up unit and the remaining plates in the stack so that the carried plate will not strike the remaining plates in the stack as the pick-up head rotates the plate away from the stack, FIGS. 7 and 8. A first sensing device 56 is positioned to sense the top of the stack when the uppermost plate is at this nominal distance. In the preferred embodiment, the first sensing device is a visible laser through beam sensor but other types of sensing devices will work. The first sensing device signals a microprocessor based controller 58 when it no longer senses a plate and the controller causes the first lifting unit 28 to raise the stack of plates until the first sensing device again senses the uppermost plate in the stack.

Referring now in particular to FIGS. 2 and 3, the first shaft 42, which carries the pick-up head 38, is journaled in a bore 60 located in a larger diameter second shaft 62. The second shaft is rotatably journaled in bearing blocks 64 located in the wall 16 and in a post 66 located on the table 12. The second shaft 62 is rotated at a rate which is faster than the first shaft 42 by a multiple equal to the number of pick-up units 40 on the pick-up head 38. Thus, in the embodiment illustrated, the second shaft rotates six times faster than the first shaft. In addition, the second shaft is rotated in the opposite direction than the first shaft.

Due to the eccentricity of the centerlines of the first and second shafts, the centerline of the first shaft defines a circle each revolution of the second shaft, or each one-sixth revolution of the first shaft. The revolution of the first and second shafts are synchronized such that the centerline of the first shaft is at its lowest point on this circle each time a pick-up unit is in position to pick-up a plate. Due to the counter rotation of the shafts, this means that the centerline of the first shaft is precessing rearwardly on this circle at the maximum rate at this point also. Thus, the surface speed of each pick-up unit is at its slowest and the gap between the pick-up unit and the uppermost plate in the stack is at its minimum when the pick-up unit is in position to pick-up a plate.

Figure 4:
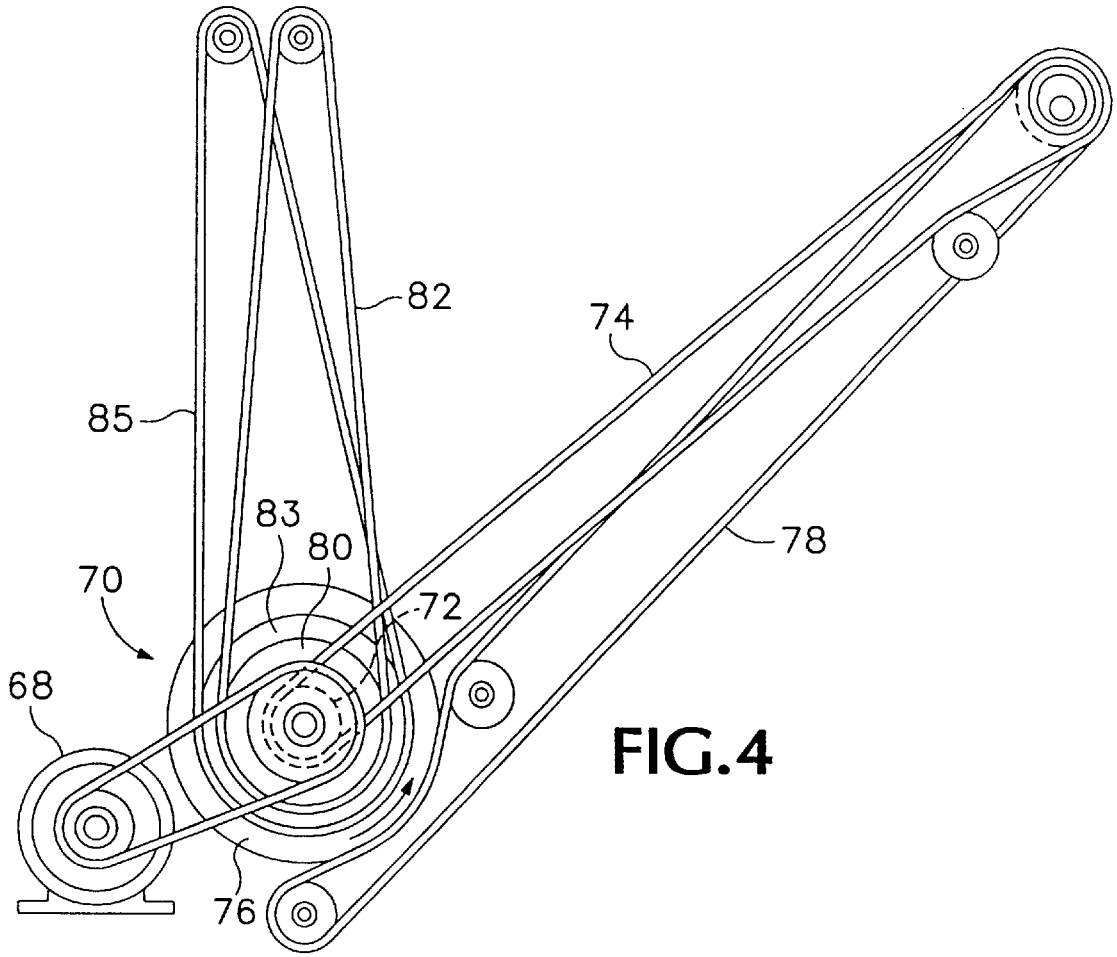
FIG. 4 is an isolated view of the mechanism which drives the plate feed apparatus.

This synchronized counter rotation is achieved by using the same motor 68 to drive both shafts. The motor rotates a sprocket set 70 having a first sprocket 72 that carries a first chain 74 which rotates the second shaft, and a second sprocket 76 that carries a second chain 78 which rotates the first shaft in the opposite direction. The sprocket set also has a third sprocket 80 that carries a chain 82 which moves the intermediate conveyer, and a fourth sprocket 83 and chain 85 which moves the outfeed conveyer 57. The motor, sprockets and chains are shown in isolation in FIG. 4.

Figure 9:
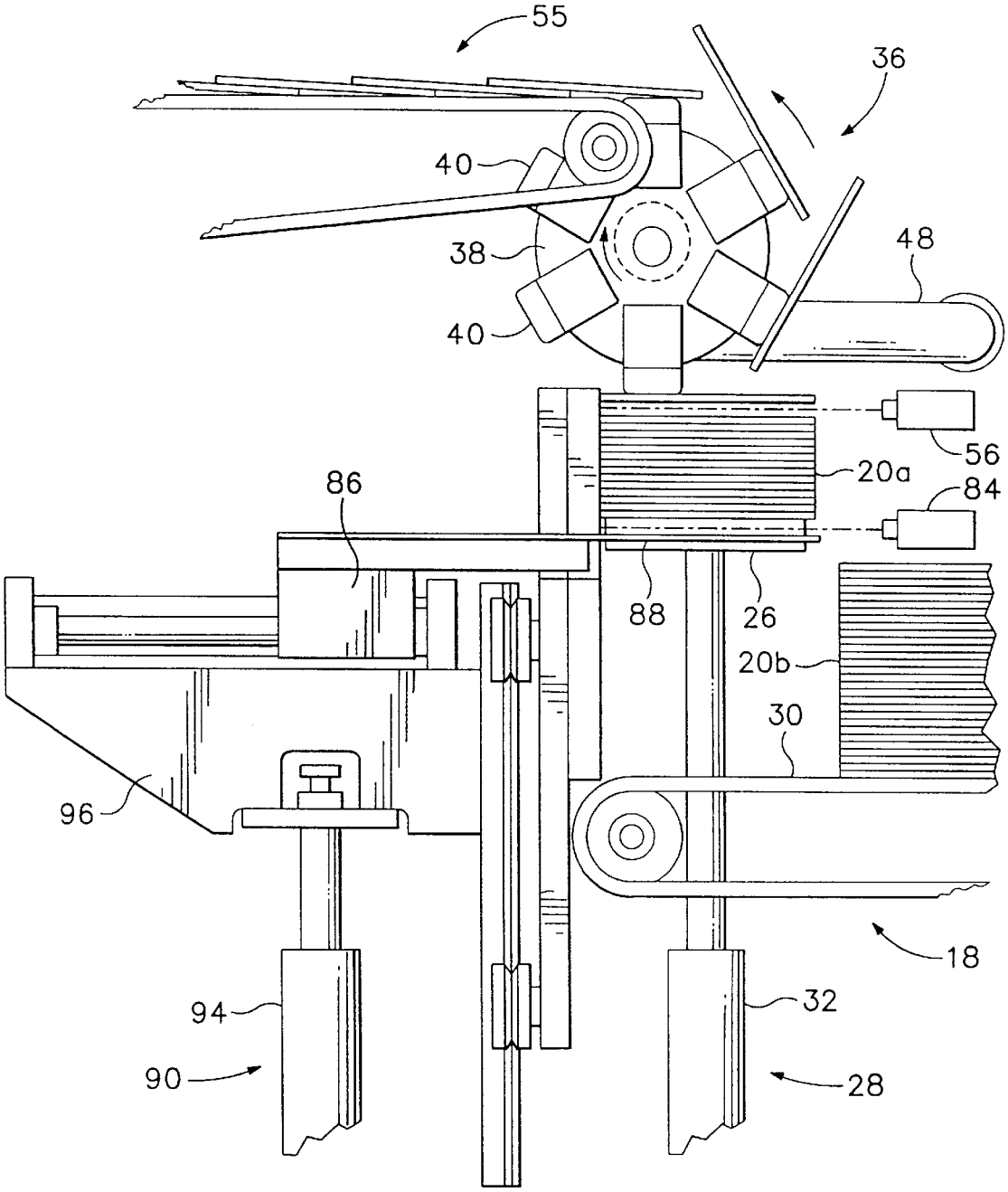
FIGS. 9–11 are side elevation views, similar to FIGS. 7 and 8, showing the sequence of operation of the plate supply mechanism.
Figure 10:
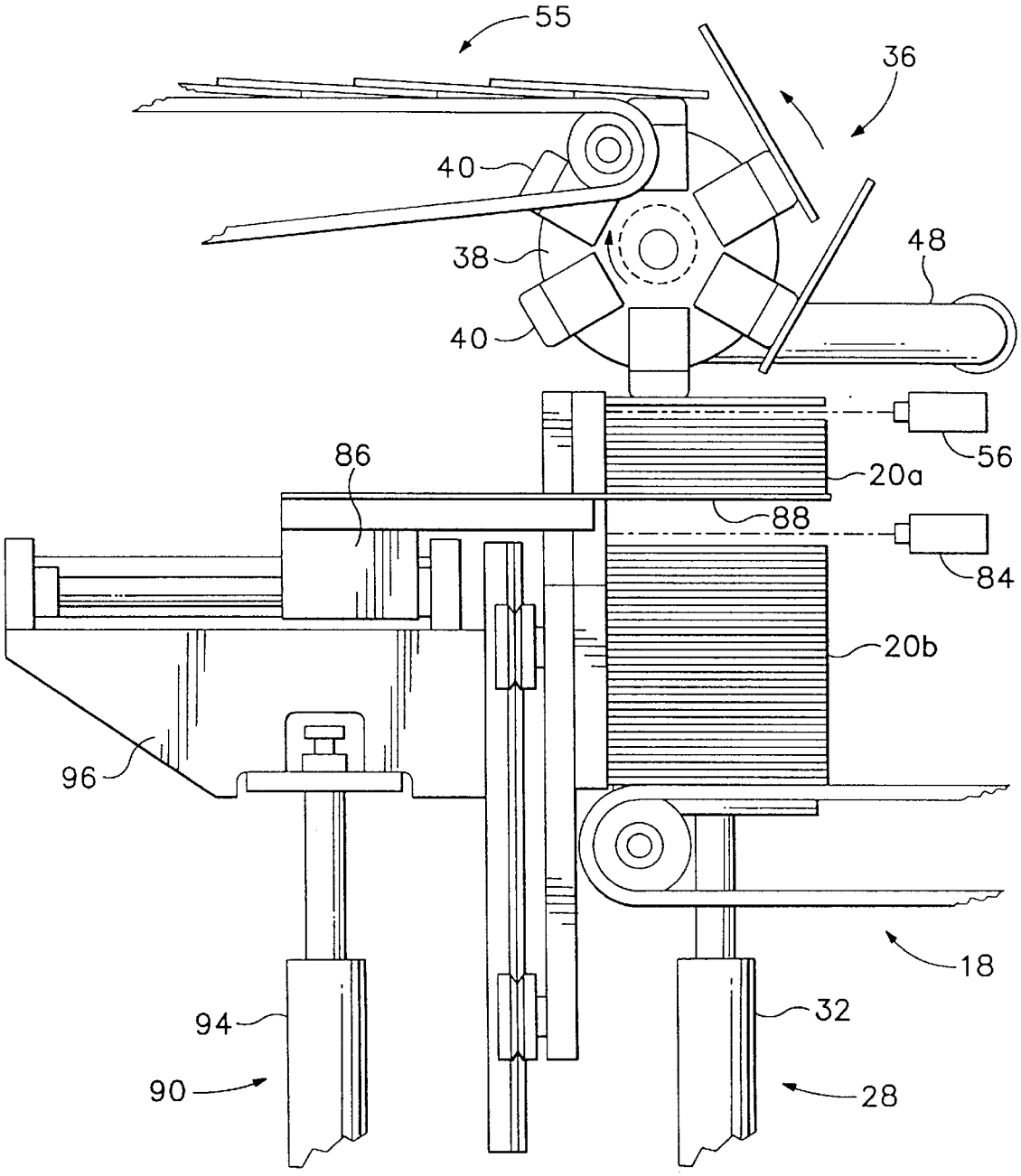
Figure 11:
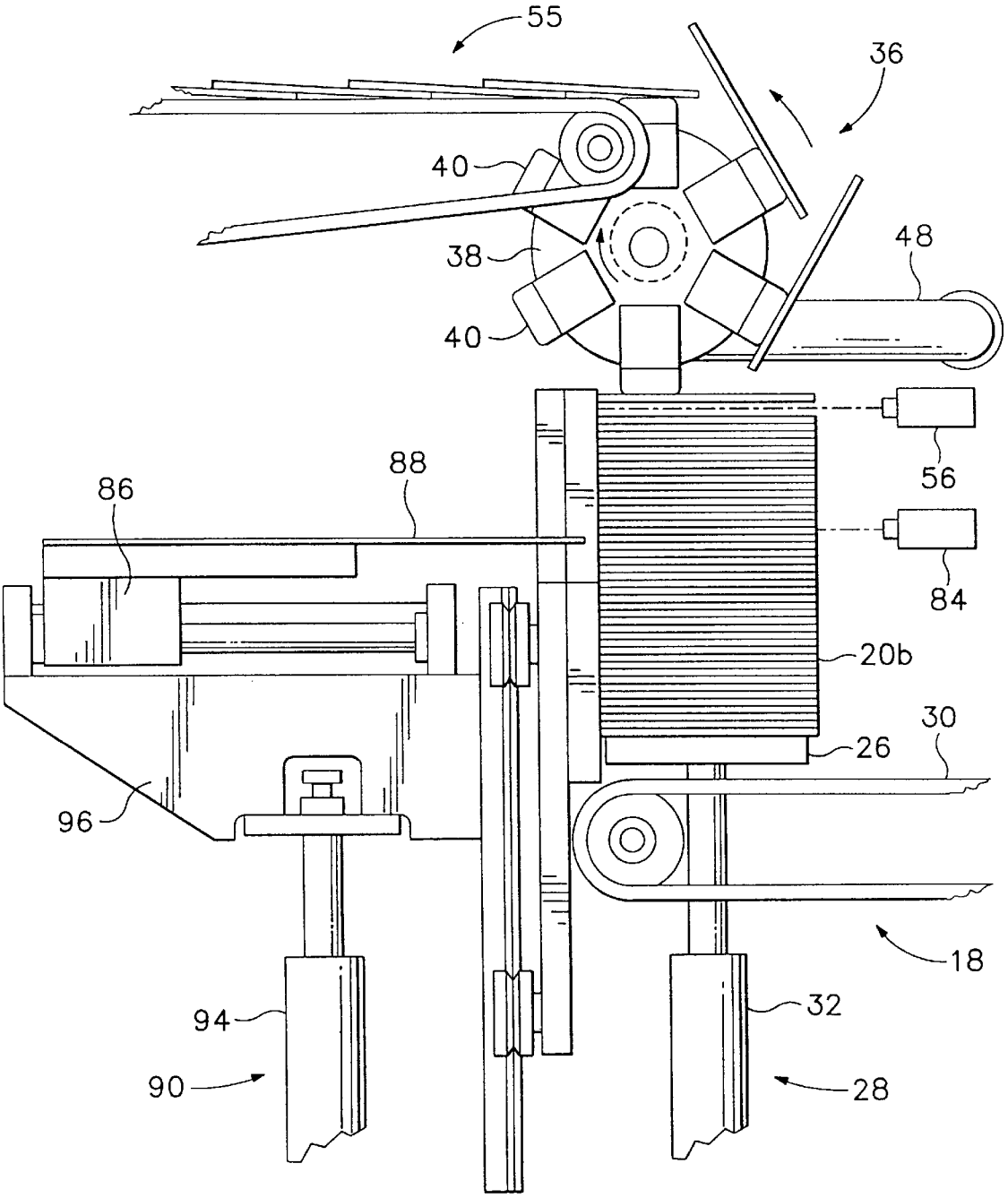

A second sensing device 84, similar to the first sensing device 56, senses when the bottom of the stack of plates 20(*a*) reaches a first predetermined level, which is below the level sensed by the first sensing device. When the bottom of the first stack reaches this level, the controller 58 causes an actuator 86 to extend a pair of extendible fingers 88 to their extended position under the stack of plates on the platform, FIG. 9. When the fingers are extended, the controller causes a second lifting device 90, comprising a motor 92 and ball screw 94, to lift a support frame 96, which carries the fingers 88, each time a plate is removed from the stack. The controller also causes the first lifting device to retract the platform. When the platform is retracted below the infeed conveyer 18, the controller causes the infeed conveyer to move a second stack of plates 20(*b*) against the stop 24. The conveyer is then stopped and the second lifting device is extended until the uppermost plate in the second stack is sensed by the second sensing device, FIG. 10. This tells the controller the distance between the platform 26 and the top of the second stack. The first and second lifting devices have feedback systems, not shown, which tell the controller how much they are extended. Thus, the controller can determine how far it must slowly extend the second lifting device to bring the top of the second stack up against the bottom of the first stack, FIG. 11. The fingers 88 are then moved to the retracted position and the support frame 96 is lowered to its original position by the second lifting device.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A plate feed device for serially moving plates from one location to another comprising:

(a) a rotating pick-up head having a predetermined number of pick-up units;

(b) a plurality of plates and a feed mechanism which places successive plates in a pick-up position proximate said pick-up units;

(c) a vacuum device which is selectively coupled to each of said pick-up units as said pick-up unit is rotated over a plate in said pick-up position to pull said plate into contact with said pick-up unit, and is uncoupled from each of said pick-up units when said pick-up unit has rotated to a drop off position to release said plate from said pick-up unit;

(d) wherein the distance between adjacent pick-up units and the speed at which said pick-up units travel as said pick-up head is rotated is established relative to the size of the plates such that the plates being carried on said pick-up head overlap one another.

2. The plate feed device of claim 1 wherein said pick-up units have a surface speed, said plate feed device including an outfeed conveying device which carries said plates out of said plate feed device, said outfeed conveying device having a surface speed which is sufficiently higher than the surface speed of said pick-up units such that said plates do not overlap one another when they are on said outfeed conveying device.

3. A method for serially moving plates from one location to another comprising:

(a) rotating a pick-up head having a predetermined number of pick-up units at a rotational rate such that said pick-up units have a predetermined surface speed;

(b) moving successive plates to a pick-up position proximate said pick-up unit;

(c) selectively providing vacuum to each of said pick-up units as said pick-up unit is rotated over a plate in said pick-up position to pull said plate into contact with said pick-up unit, and disconnecting vacuum when said pick-up unit has rotated to a drop off position to release said plate from said pick-up unit; and (d) establishing the distance between adjacent pick-up units and the speed at which said pick-up units travel as said pick-up head is rotated relative to the size of the plates such that the plates being carried on said pick-up head overlap one another.

4. The method of claim 3 including providing an outfeed conveying device which receives plates from said pick-up units, said outfeed conveying device having a surface speed which is sufficiently higher than the surface speed of said pick-up units such that said plates do not overlap one another when they are on said outfeed conveying device.

* * * * *